US009461372B2

(12) United States Patent
Ohkubo et al.

(10) Patent No.: US 9,461,372 B2
(45) Date of Patent: Oct. 4, 2016

(54) FEMALE TERMINAL FITTING

(71) Applicant: Yazaki Corporation, Minato-ku, Tokyo (JP)

(72) Inventors: Yoshitaka Ohkubo, Kakegawa (JP); Takeshi Innan, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/935,933

(22) Filed: Nov. 9, 2015

(65) Prior Publication Data

US 2016/0064834 A1 Mar. 3, 2016

Related U.S. Application Data

(63) Continuation of application No. PCT/JP2014/062113, filed on May 1, 2014.

(30) Foreign Application Priority Data

May 13, 2013 (JP) ..... 2013-101596

(51) Int. Cl.
*H01R 13/11* (2006.01)
*H01R 4/16* (2006.01)
*H01R 43/16* (2006.01)

(52) U.S. Cl.
CPC ..... *H01R 4/16* (2013.01); *H01R 13/112* (2013.01); *H01R 43/16* (2013.01)

(58) Field of Classification Search
CPC .... H01R 13/112; H01R 13/11; H01R 13/113
USPC ..... 439/857, 856
See application file for complete search history.

(56) References Cited

U.S. PATENT DOCUMENTS 3,727,175 A * 4/1973 Grenda ..... H01R 12/728 206/717
4,752,254 A * 6/1988 Inoue ..... H05K 3/4084 361/760

(Continued)

FOREIGN PATENT DOCUMENTS

JP 3-50730 U 5/1991
JP 2003-123887 A 4/2003

(Continued)

OTHER PUBLICATIONS

Written Opinion dated Jul. 15, 2014, issued by the International Searching Authority in counterpart International Application No. PCT/JP2014/062113 (PCT/IB/338, PCT/IB/373, PCT/ISA/237).

(Continued)

*Primary Examiner* — Gary Paumen
(74) *Attorney, Agent, or Firm* — Sughrue Mion, PLLC

(57) ABSTRACT

A female terminal fitting includes terminal holding plates stacked on one another are configured of a basic terminal holding plate formed integrally with one end of an electric wire connecting portion and auxiliary terminal holding plates which are formed on corresponding edges of the basic terminal holding plate via corresponding bending margins and which are folded up and then down on to the basic terminal holding plate so that the auxiliary terminal holding plates are in a stacked state on the basic terminal holding plate. A fixing piece is formed integrally on an auxiliary terminal holding plate which is stacked at an uppermost level at an edge portion on a side which lies opposite to a side where the bending margin is provided, so as to be brought into engagement with a locking portion on the basic terminal holding plate to fix the stacked state.

3 Claims, 9 Drawing Sheets

(56) References Cited

U.S. PATENT DOCUMENTS

| | | | | |
|---|---|---|---|---|
| 5,046,972 | A * | 9/1991 | Pass | H05K 7/1084 439/249 |
| 5,064,379 | A * | 11/1991 | Ryll | H01R 9/091 439/81 |
| 5,730,629 | A * | 3/1998 | Samejima | H01R 13/113 29/874 |
| 5,833,500 | A * | 11/1998 | Mahon | H01R 13/113 29/874 |
| 5,957,734 | A * | 9/1999 | Gladd | H01R 13/11 439/857 |
| 6,652,322 | B2 * | 11/2003 | Ito | H01R 12/721 439/637 |
| 7,137,854 | B2 * | 11/2006 | Casses | H01R 13/113 439/852 |
| 7,331,831 | B2 * | 2/2008 | Cvasa | H01R 13/115 439/857 |
| 9,300,069 | B2 * | 3/2016 | Morello | H01R 13/18 |
| 2002/0065006 | A1 * | 5/2002 | Heimueller | H01R 13/113 439/856 |
| 2003/0124918 | A1 | 7/2003 | Schremmer et al. | |
| 2005/0221690 | A1 | 10/2005 | Suzuki et al. | |
| 2012/0156909 | A1 | 6/2012 | Tyler | |

FOREIGN PATENT DOCUMENTS

| | | | |
|---|---|---|---|
| JP | 2003-234153 | A | 8/2003 |
| JP | 2005-294220 | A | 10/2005 |

OTHER PUBLICATIONS

Search Report and Written Opinion dated Jul. 15, 2014 issued in International Application No. PCT/JP2014/062113 (PCT/ISA/210/220/237).

* cited by examiner

FEMALE TERMINAL FITTING

CROSS REFERENCE TO RELATED APPLICATION

This application is a continuation of PCT application No. PCT/JP2014/062113, which was filed on May 1, 2014 based on Japanese Patent Application (No. 2013-101596) filed on May 13, 2013, the contents of which are incorporated herein by reference. Also, all the references cited herein are incorporated as a whole.

BACKGROUND OF THE INVENTION

1. Technical Field

One or more embodiments of the present invention relate to a female terminal fitting having a terminal connecting portion which is formed by arranging for a plurality of terminal holding plates to be stacked on one another.

2. Description of the Related Art

FIG. 9 shows a female terminal fitting disclosed in PTL 1 below.

The female terminal fitting 100 includes a terminal connecting portion 110 in which a plate-shaped mating terminal fitting is fitted for connection and an electric wire connecting portion 120 which is provided continuously at a proximal end of the terminal connecting portion 110.

The terminal connecting portion 110 is formed by stacking a plurality of terminal holding plates 111 which are formed of metallic plates in a thickness direction of the terminal connecting portion 110. The plurality of terminal holding plates 111 are terminal plates which are formed independently of one another. In each terminal holding plate 111, a pair of arm plates 113, 114 which extend substantially parallel from a proximal plate portion 112 forma terminal holding groove 115 into which the plate-shaped mating terminal fitting can be inserted.

Contact portions 113*a*, 114*a* are provided on inner side surfaces of the pair of arm plates 113, 114 of each terminal holding plate 111 at a distal end side thereof so as to project therefrom for press contact with the plate-shaped mating terminal inserted into the groove.

The terminal connecting portion 110 which is formed by stacking the plurality of terminal holding plates 111 on one another establishes an electrical connection with the mating terminal fitting by holding the plate-shaped mating terminal fitting which is inserted into the terminal holding groove 115 by the contact portions 113*a*, 114*a* which are provided on each of the terminal holding plates 111.

The plurality of terminal holding plates 111 which are stacked on one another are fix in such a stacked state by fastening the proximal plate portions 112 which are stacked on one another with a screw member 130. The screw member 130 is a screw member which is screwed into a holding plate fixing portion 121 of the electric wire connecting portion 120 and also functions as a connecting device which connects a proximal end of the terminal connecting portion 110 to the electric wire connecting portion 120.

The electric wire connecting portion 120 in PTL 1 includes the holding plate fixing portion 121 to which the terminal connecting portion 110 is fastened with the screw member, a male screw member 122 which extends from the holding plate fixing portion 121, and a fastening nut 123 which is screwed on to the male screw member 122.

For example, a screw fastening crimping terminal which is crimped to an end of an electric wire is passed on the male screw member 122. The fastening nut 123 holds the screw fastening crimping terminal which is passed on to the male screw member 122 between the holding plate fixing portion 121 and itself to conductively connect the electric wire to the electric wire connecting portion 120.

The terminal connecting portion 110 of the female terminal fitting 100 can realize a multi-contact connection which is advantageous in improving the contact reliability by the multiplicity of contact portions 113*a*, 114*a* contacting the mating terminal fitting.

PTL 1 is JP-A-2005-294220.

SUMMARY OF THE INVENTION

In the female terminal fitting 100 in PTL 1, however, since the plurality of terminal holding plates 111 which are formed independently of one another are integrated into the stacked configuration by fastening the terminal holding plates 111 with the screwing member, it requires some time in forming the stacked configuration. Additionally, the plurality of terminal holding plates 111 which are to be stacked on one another have to be positioned neatly with high accuracy before they are integrated into the stacked configuration, which requires an exclusive positioning jig in assembling the stacked configuration. Further, although the terminal holding plates 111 are formed by pressing metallic plates, the electric wire connecting portion 120 is formed by machining a metallic rod. Namely, the female terminal fitting 100 in PTL 1 is configured of the plurality of parts which are worked differently. This causes a problem that the fabrication process becomes complex, and the fabrication costs are increased expensively.

In addition, since the female terminal fitting 100 in PTL 1 includes the male screw member for connection with the electric wire, there is caused a problem that including the screw member increases electric resistance accordingly.

Furthermore, in the case of the terminal connecting portion 110 of the female terminal fitting 100 in PTL 1, there is provided at the distal end portion of the plurality of the terminal holding plates 111 which are stacked on one another no means which restricts a displacement in the thickness direction of the terminal connecting portion 110. Accordingly, the stacked terminal holding plates may separate from one another due to warping, and the separation of the terminal holding plates may lead to a reduction in holding force to the mating terminal fitting.

Then, an object of the embodiments of the invention relates to solving the problems described above and is to provide a female terminal fitting which can realize a reduction in fabrication costs by simplifying a fabrication process and which is free from the separation of terminal holding plates which are stacked on one another which would otherwise occur due to warping so as to hold firmly a plate-shaped mating terminal fitting, whereby a stable connecting performance can be maintained.

The described object of the embodiments is achieved by the following configurations.

(1) A female terminal fitting including:

a terminal connecting portion which is formed by stacking a plurality of metallic terminal holding plates on one another and which enables a plate-shaped mating terminal fitting to be inserted into terminal holding grooves which are formed individually in the terminal holding plates so as to communicate with one another; and an electric wire connecting portion which is provided so as to continue to the terminal connecting portion and to which an electric wire is connected, wherein the plurality of terminal holding plates are configured of a basic terminal holding plate which is formed integrally with one end of the electric wire connecting portion, and a plurality of auxiliary terminal holding plates which are formed integrally with corresponding edges of the basic terminal holding plate via corresponding bending margins and which are folded up and then down on to the basic terminal holding plate at portions where the bending margins are provided so that the auxiliary terminal holding plates are in a stacked state on the basic terminal holding plate, and on an auxiliary terminal holding plate in the plurality of auxiliary terminal holding plates which is stacked to be at an uppermost level, a fixing piece is formed integrally with an edge portion at a side which lies opposite to a side where the bending margin is provided, the fixing portion being configured so as to be brought into engagement with a locking portion which is formed on the basic terminal holding plate in such a state that the auxiliary terminal holding plate which is to be stacked at the uppermost level is so stacked as an uppermost layer to fix the plurality of auxiliary terminal holding plates which are stacked on one another.

(2) In the female terminal fitting according to (1) above, the terminal holding grooves include terminal insertion grooves into which the mating terminal fitting can be inserted and contact portions which are provided on facing inner side surfaces of the terminal insertion grooves so as to project therefrom for press contact with surfaces of the mating terminal fitting which is inserted into the terminal insertion grooves, and in the stacked state of the plurality of terminal holding plates, the plurality of contact portions are formed in positions which are offset from each other in an inserting direction of the mating terminal fitting.

(3) In the female terminal fitting according to (1) or (2) above, the electric wire connecting portion includes an electric wire placement plate portion which is made of a metallic plate and which extends from a proximal end of the basic terminal holding plate to place the electric wire thereon and crimping pieces which are provided on both side edges of the electric wire placement plate portion so as to extend therefrom to be crimped to the electric wire which is placed on the electric wire placement plate portion.

According to the configuration described under (1) above, the plurality of terminal holding plates which configure the terminal connecting portion are provided as the single metallic plate which is continuous via the bending margins. The plurality of auxiliary terminal holding plates which continue to the basic terminal holding plate via the bending margins are folded at the portions where the bending margins are provided and are then stacked on the basic terminal holding plate, whereby the auxiliary terminal holding plates are stacked on one another on the basic terminal holding plate.

In addition, when the terminal holding plate (the auxiliary terminal holding plate) which is to be folded and stacked at the uppermost level is so folded and stacked completely, the fixing piece which is provided on the terminal holding plate being folded and stacked at the uppermost level is brought into engagement with the locking portion of the lowermost terminal holding plate, whereby the uppermost terminal holding plate is fixed to the lowermost terminal holding plate. In this state, the plurality of terminal holding plates which lie middle between the uppermost and lowermost levels are sandwiched by the uppermost terminal holding plate and the lowermost terminal holding plate, so that the stacked state is fixed.

Namely, according to the configuration described under (1) above, the terminal connecting portion which is configured of the plurality of terminal holding plates which are stacked on one another can be fabricated only through pressing, and this simplifies the fabrication process, whereby a reduction in fabrication costs can be realized.

Additionally, according to the configuration described under (1) above, the uppermost terminal holding plate is fixed to the lowermost terminal holding plate by the bending margin which is situated at the one end side and the fixing piece which is situated at the other end side. Namely, the uppermost terminal holding plate and the lowermost terminal holding plate hold firmly the plurality of middle terminal holding plates in such a state that both the uppermost and lowermost terminal holding plates are fastened at the end portions. Consequently, there is no such situation that the stacked terminal holding plates are separated from one another due to warping. Therefore, there is no such situation that the stacked terminal holding plates are separated from one another to reduce the holding force with which the mating terminal fitting is held. Thus, the plate-shaped mating terminal fitting can be held firmly, whereby the stable connecting performance can be maintained.

According to the configuration described under (2) above, the multiplicity of contact portions which are disposed on the terminal holding groove in the terminal holding portion are disposed so as to be separated to the plurality of locations which are offset in the inserting direction of the mating terminal fitting into the terminal holding groove, whereby the multiple contact connection can be realized in which the terminal holding portion contacts the mating terminal fitting widely over the mating terminal fitting, thereby making it possible to improve the contact reliability with the mating terminal fitting. Additionally, since the contact portions are disposed so as to be separated to the plurality of locations, the inserting force required when the mating terminal fitting is inserted is reduced.

According to the configuration described under (3) above, since the electric wire connecting portion is also made of the metallic plate, the whole of the female terminal fitting including the terminal connecting portion can be fabricated only through pressing, and this also simplifies the fabrication process, whereby the fabrication costs can be reduced further.

In addition, according to the configuration described under (1) above, the electric wire connecting portion is made of the metallic plate and includes no electric wire connecting male screw member. Thus, there is no such situation that the electric resistance of the female terminal fitting is increased.

According to the female terminal fitting of the embodiments, the fabrication costs can be reduced by simplifying the fabrication process. Moreover, there is no such situation that the stacked terminal holding plates are separated from one another due to warping. Thus, the plate-shaped mating terminal fitting can be held firmly, whereby the stable connecting performance can be maintained.

Thus, the embodiments of the invention have been briefly described. Further, perusing a mode for carrying out the invention (hereinafter, referred to as an "embodiment") which will be described below by reference to accompanying drawings will clarify further the details of the invention.

BRIEF DESCRIPTION OF THE DRAWINGS

FIGS. 7A to 7D are explanatory drawings of a fabrication process of fabricating the terminal connecting portion from the developed state shown in FIG. 6 through repeated bending steps, in which FIG. 7A is an explanatory drawing showing a first bending step, FIG. 7B is an explanatory drawing showing a second bending step, FIG. 7C is an explanatory drawing showing a third bending step, and FIG. 7D is an explanatory diagram showing a final bending step.

FIGS. 8A to 8B are explanatory drawings of forms of connecting a mating terminal fitting to the female terminal fitting of the embodiment, in which FIG. 8A is a perspective view showing a connection form in which electric wires connected to both the terminal fittings are positioned coaxial, and FIG. 8B is a perspective view showing a connection form in which electric wires connected to both the terminal fittings extend in directions orthogonal to each other.

DETAILED DESCRIPTION OF THE EXEMPLARY EMBODIMENTS

Figure 1:
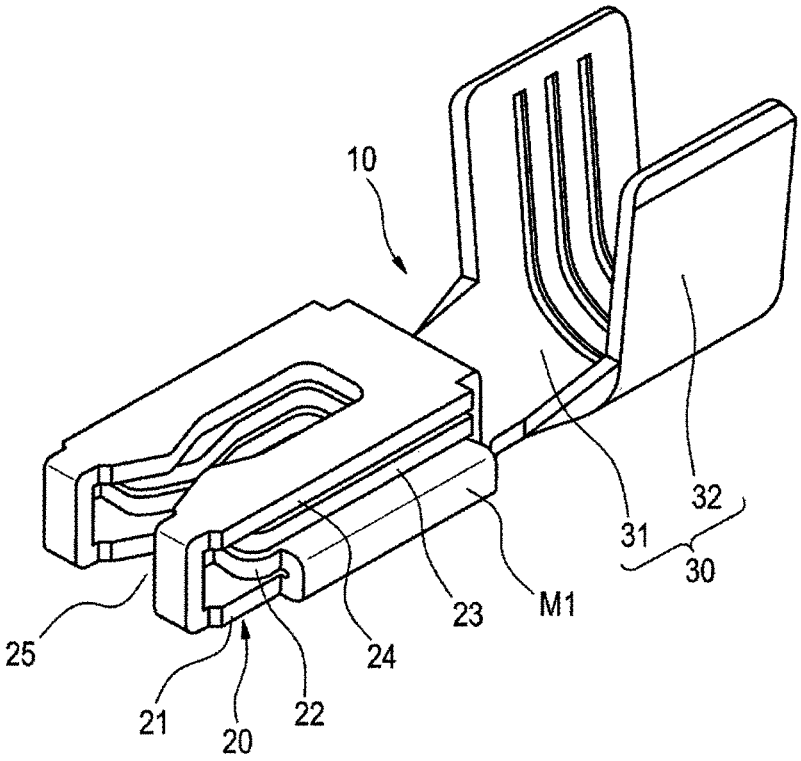
FIG. 1 is a perspective view of a female terminal fitting of an embodiment according to the invention as seen obliquely from a front upper position.

Hereinafter, referring to the drawings, a preferred embodiment of a female terminal fitting according to the invention will be described in detail.

Figure 2:
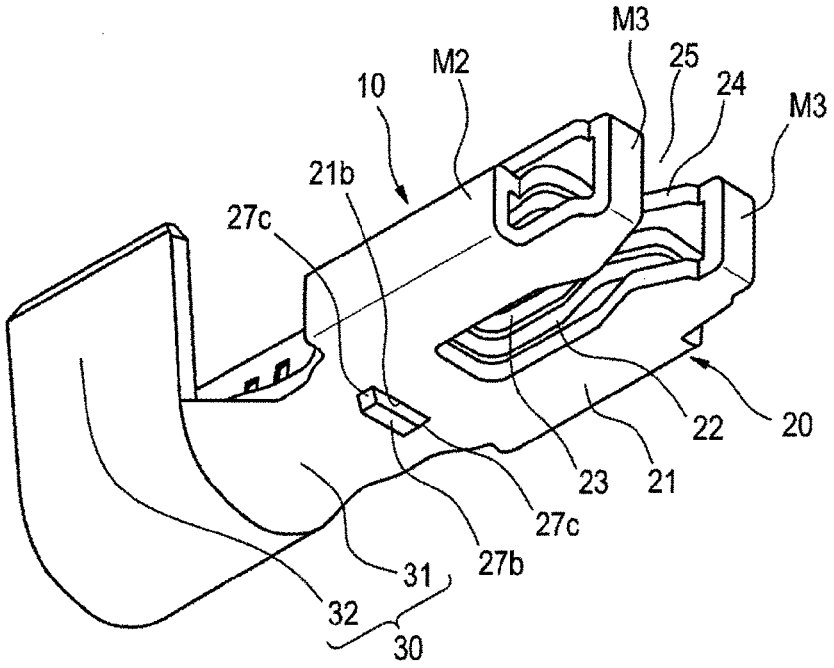
FIG. 2 is a perspective view of the female terminal fitting of the embodiment as seen obliquely from a front lower position.
Figure 3:
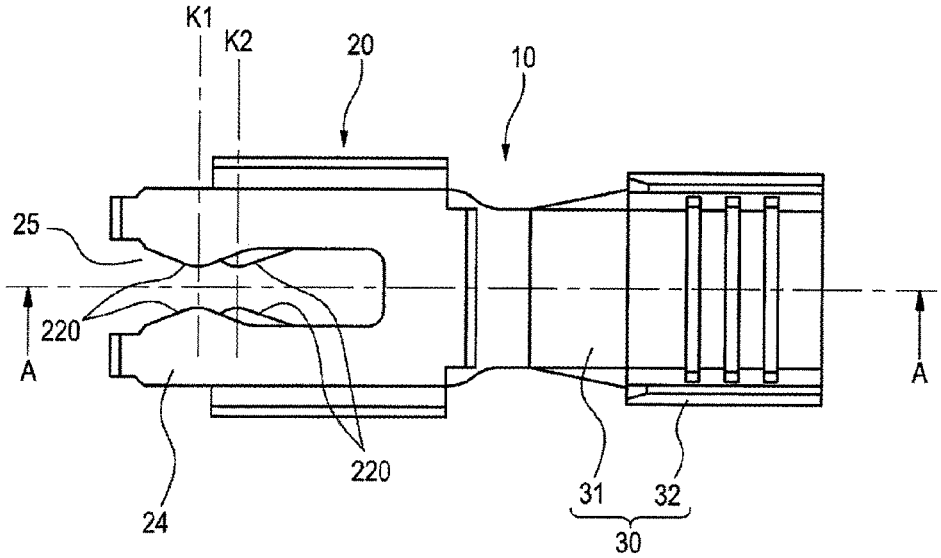
FIG. 3 is a plan view of the female terminal fitting of the embodiment.
Figure 4:
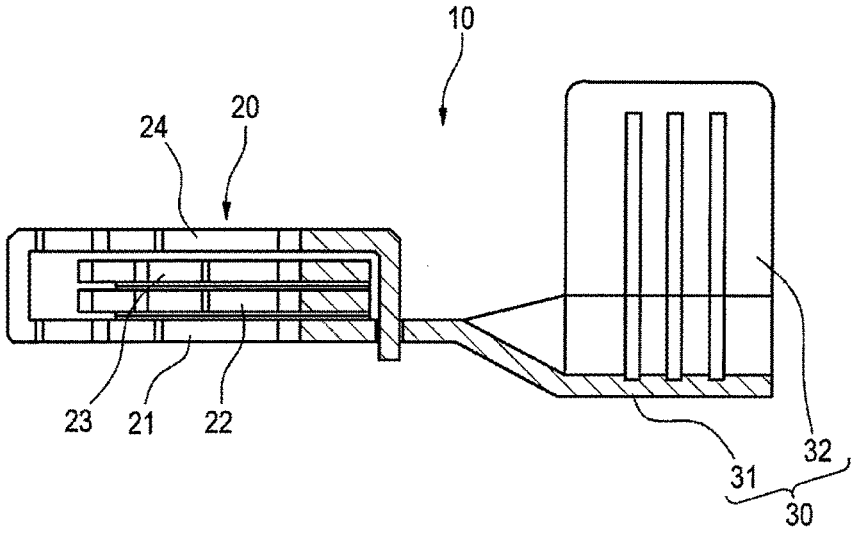
FIG. 4 is a sectional view taken along a line A-A in FIG. 3.
Figure 5:
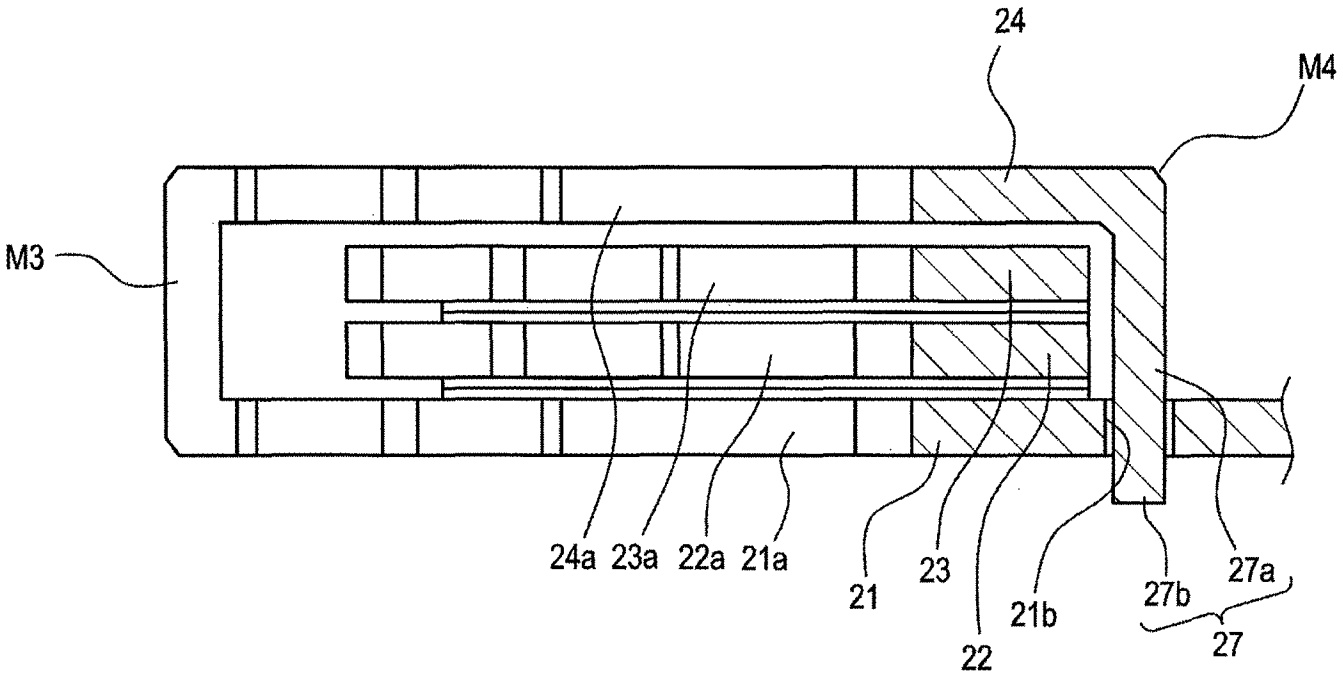
FIG. 5 is an enlarged view of a terminal connecting portion shown in FIG. 4.
Figure 6:
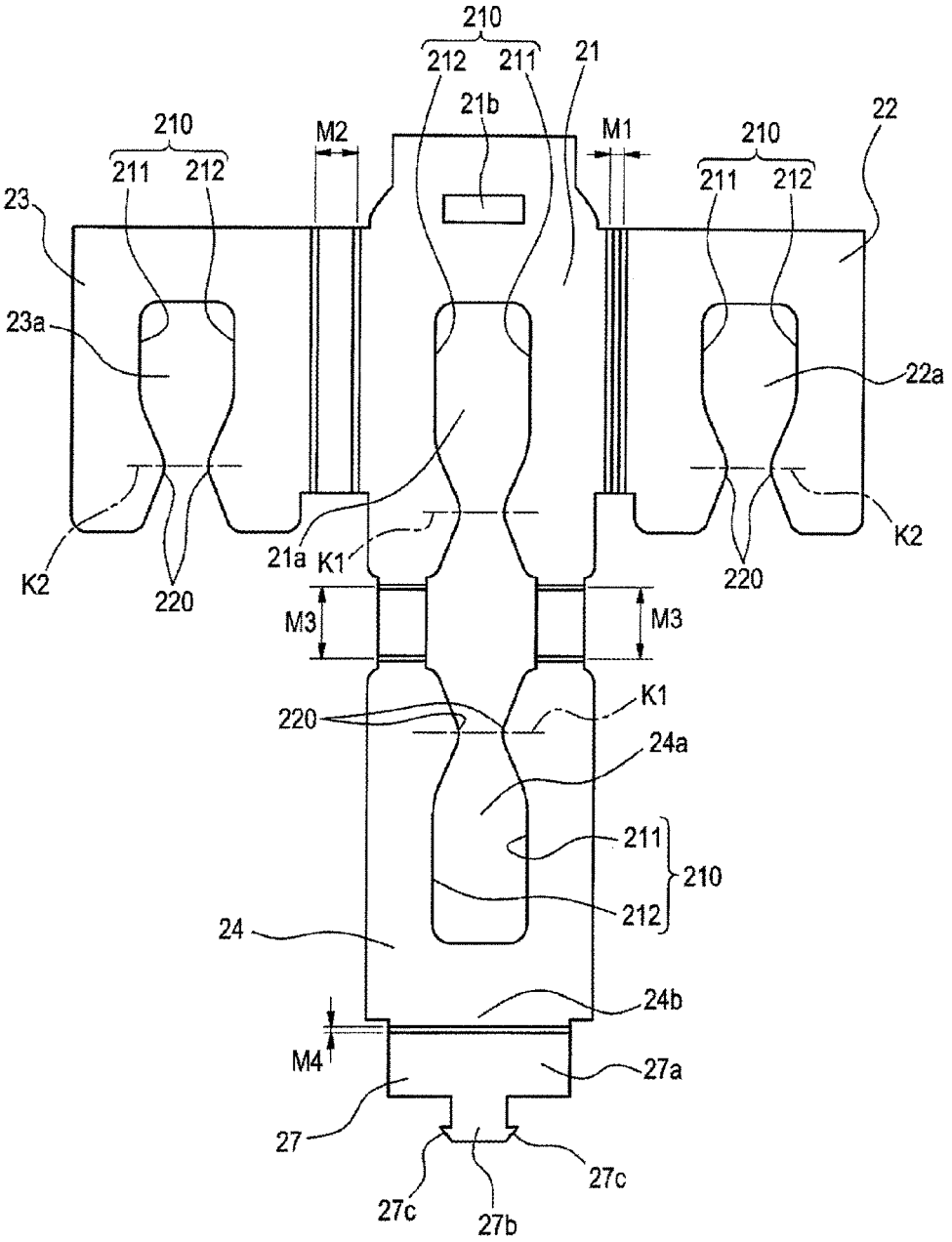
FIG. 6 is a development view of the terminal connecting portion shown in FIG. 5.

FIGS. 1 to 8 show an embodiment of a female terminal fitting according to the invention. FIG. 1 is a perspective view of a female terminal fitting of an embodiment according to the invention as seen obliquely from a front upper position. FIG. 2 is a perspective view of the female terminal fitting of the embodiment as seen obliquely from a front lower position. FIG. 3 is a plan view of the female terminal fitting of the embodiment. FIG. 4 is a sectional view taken along a line A-A in FIG. 3. FIG. 5 is an enlarged view of a terminal connecting portion shown in FIG. 4. FIG. 6 is a development view of the terminal connecting portion shown in FIG. 5. FIGS. 7A to 7D are explanatory drawings of a fabrication process of fabricating the terminal connecting portion from the developed state shown in FIG. 6 through repeated bending steps, in which FIG. 7A is an explanatory drawing showing a first bending step, FIG. 7B is an explanatory drawing showing a second bending step, FIG. 7C is an explanatory drawing showing a third bending step, and FIG. 7D is an explanatory diagram showing a final bending step. FIGS. 8A to 8B are explanatory drawings of forms of connecting a mating terminal fitting to the female terminal fitting of the embodiment, in which FIG. 8A is a perspective view showing a connection form in which electric wires connected to both the terminal fittings are positioned coaxial, and FIG. 8B is a perspective view showing a connection form in which electric wires connected to both the terminal fittings extend in directions orthogonal to each other.

A female terminal fitting 10 of this embodiment is a product fabricated by pressing a metallic plate and includes a terminal connecting portion 20 and the electric wire connecting portion 30 as shown in FIGS. 1 to 4.

As shown in FIG. 5, the terminal connecting portion 20 is formed by stacking four terminal holding plates 21, 22, 23, 24 which are each made of a metallic plate. The terminal fitting portion 20 accomplishes conductive connection with a plate-shaped mating terminal fitting 40 (refer to FIGS. 8A and 8B) as a result of the mating terminal fitting 40 being inserted into a terminal holding groove 25.

The terminal holding groove 25 of the terminal connecting portion 20 is formed as a result of, as shown in FIG. 5, terminal holding grooves 21*a*, 22*a*, 23*a*, 24*a* which are formed in the terminal holding plates 21, 22, 23, 24, respectively, being stacked on one another in such away as to communicate with one another in a stacked direction so that the mating terminal fitting 40 can be inserted thereinto.

As shown in FIG. 6, the four terminal holding plates 21, 22, 23, 24 are configured of the basic terminal holding plate 21 which is formed integrally with one end of the electric wire connecting portion 30 and the three auxiliary terminal holding plates 22, 23, 24 which are formed integrally with a circumference of the basic terminal holding plate 21.

The three auxiliary terminal holding plates 22, 23, 24 are all formed integrally with corresponding edges of the basic terminal holding plate 21 via bending margins M1, M2, M3, respectively. Then, the three auxiliary terminal holding plates 22, 23, 24 are folded at portions where the bending margins M1, M2, M3 are provided so as to be in a stacked state on the basic terminal holding plate 21 as shown in FIGS. 7A to 7D, producing a stacked-up configuration where the three auxiliary terminal holding plates 22, 23, 24 are stacked up on the basic terminal holding plate 21.

As shown in FIG. 6, the auxiliary terminal holding plate 24 which is stacked up to be positioned at an uppermost level is formed integrally with a distal end of the basic terminal holding plate 21 via the bending margin M3. A locking hole 21*b* is formed in the basic terminal holding plate 21 at a proximal end (an opposite end portion to the distal end) side thereof as a locking portion which locks a fixing piece 27, which will be described later.

Figure 7A:
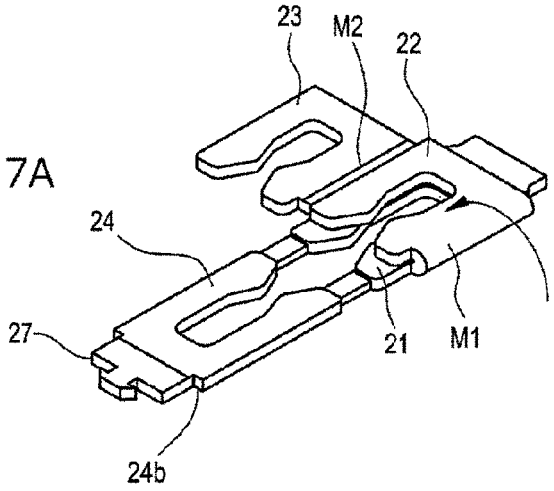
Figure 7B:
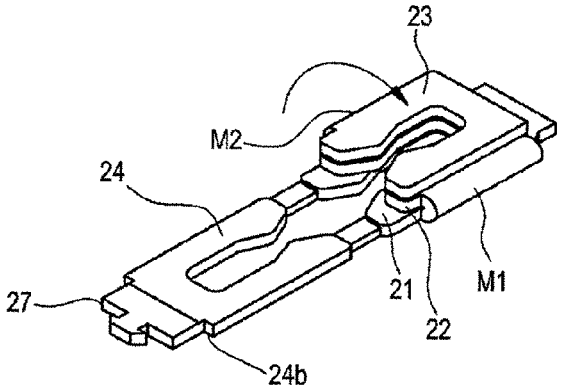
Figure 7C:
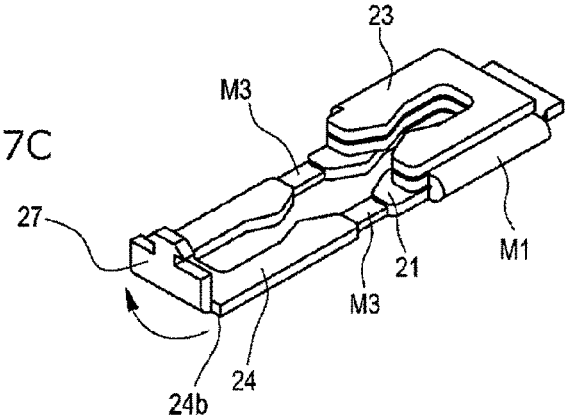
Figure 7D:
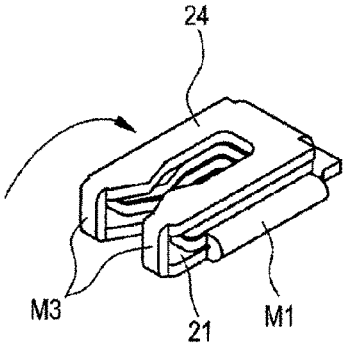

In the case of this embodiment, as shown in FIG. 6, on the auxiliary terminal holding plate 24 in the plurality of auxiliary terminal holding plates 22, 23, 24 which is stacked up to be positioned at the uppermost level, the fixing piece 27 is formed, via the bending margin M4, integrally with an edge portion 24*b* on an opposite side to the side where the bending margin M3 is provided. As shown in FIG. 7C, this fixing piece 27 is formed by being bent so as to be orthogonal to the auxiliary terminal holding plate 24 before the auxiliary terminal holding plate 24 is folded to be laid down on the auxiliary terminal holding plate 23.

The fixing piece 27 includes a wide erect wall portion 27*a* which extends from the edge portion 24*b* of the auxiliary terminal holding plate 24 and a narrow engaging projecting portion 27*b* which is provided at a transverse center of the erect wall portion 27*a* so as to project therefrom. The engaging projecting portion 27*b* is a projecting piece which is brought into engagement with the locking hole 21*b* formed in the basic terminal holding plate 21 as shown in FIG. 5. As shown in FIG. 6, a withdrawal preventing projection 27*c* is provided at each side of a distal end of the engaging projecting portion 27*b*. The withdrawal preventing projections 27*c* are brought into engagement with a rear circumferential edge portion of the locking hole 21*b* when the engaging projecting portion 27*b* fits in the locking hole 21*b* engagingly as shown in FIG. 2 to thereby prevent the withdrawal of the engaging projecting portion 27*b*.

When the auxiliary terminal holding plate 24 is folded to be stacked on top of the auxiliary terminal holding plate 23 with the fixing piece 27 bent to be erected from the auxiliary terminal holding plate 24 as shown in FIG. 7C, the fixing piece 27 is brought into engagement with the locking hole 21*b* formed in the basic terminal holding plate 21 to thereby fix the auxiliary terminal holding plates 22, 23, 24 in the stacked state, as shown in FIG. 5.

In the case of this embodiment, the terminal holding grooves 21*a*, 22*a*, 23*a*, 24*a* which are respectively formed in the terminal holding plates 21, 22, 23, 24, each includes, as shown in FIG. 6, a terminal insertion groove 210 into which the plate-shaped mating terminal fitting 40 can be inserted and contact portions 220 which are provided on opposite inner side surfaces 211, 212 of the terminal insertion groove 210 so as to project therefrom. The contact portions 220 are brought into press contact with surfaces of the mating terminal fitting 40 which is inserted into the terminal insertion groove 210 to thereby accomplish conductive connection with the mating terminal fitting 40.

In the case of this embodiment, the contact portions 220 are set on the terminal holding plates 21, 22, 23, 24 so as to be positioned at two locations K1, K2 which are offset in the inserting direction of the mating terminal fitting 40 as shown in FIG. 3 in the stacked state of the four terminal holding plates 21, 22, 23, 24.

In the case of this embodiment, the contact portions 220 of the basic terminal holding plate 21 and the uppermost auxiliary terminal holding plate 24 are set to be positioned at a location denoted as K1 in FIG. 3, and the contact portions 220 of the intermediate auxiliary terminal holding plates 22, 23 are set to be positioned at a location denoted as K2 in FIG. 3.

Figure 8A:
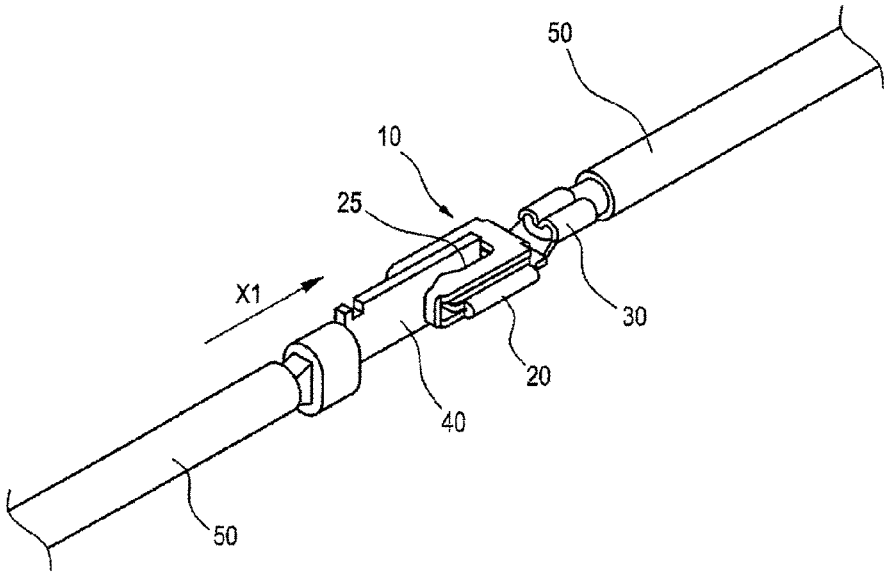
Figure 8B:
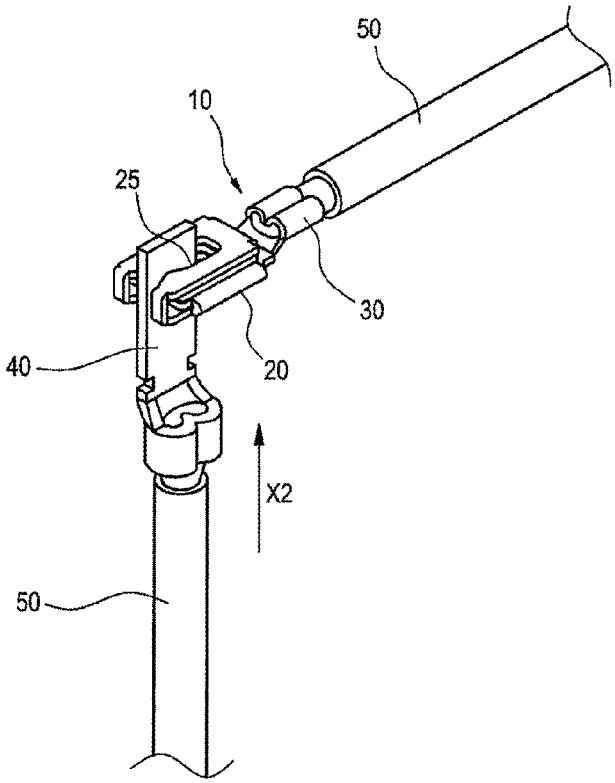
Figure 9:
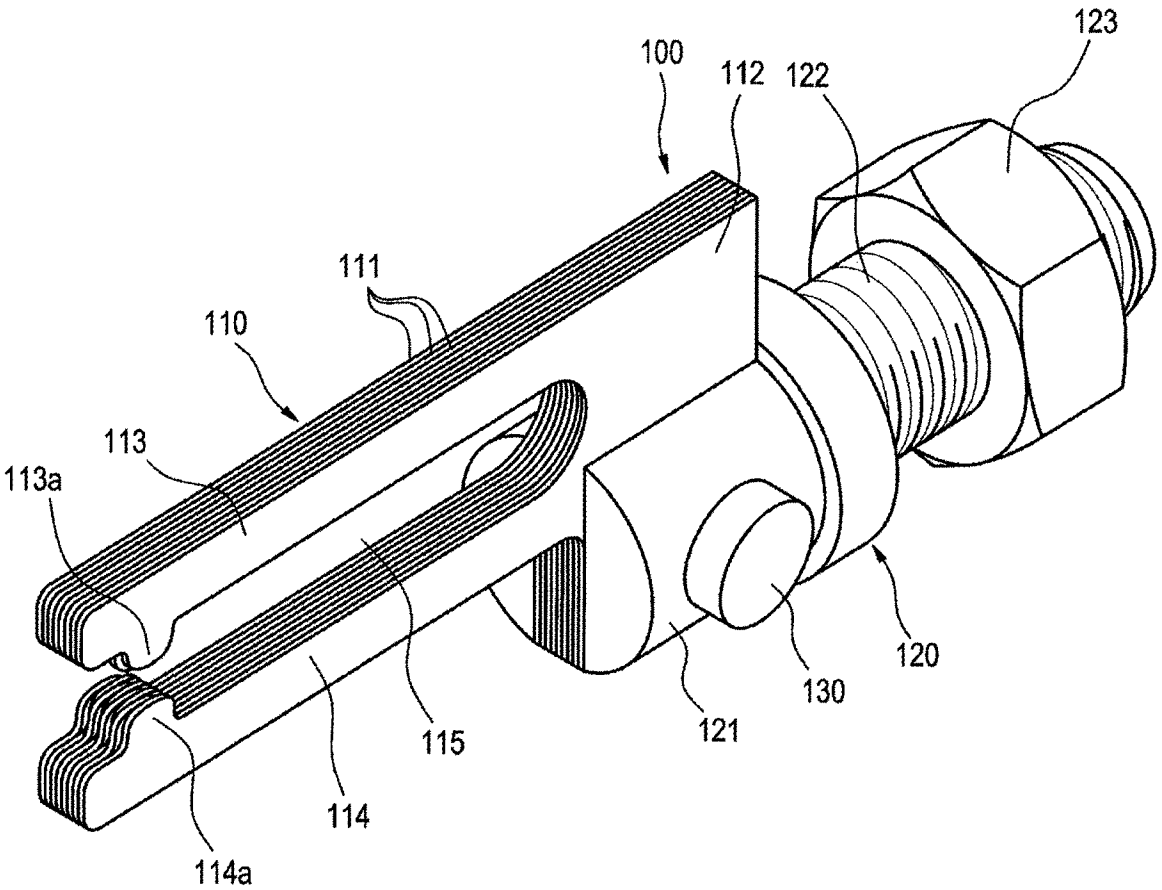
FIG. 9 is a perspective view of a related-art female terminal fitting.

In this embodiment, the electric wire connecting portion 30 is provided so as to continue to a proximal end of the terminal connecting portion 20, and an electric wire 50 is connected to the electric wire connecting portion 30 as shown in FIGS. 8A and 8B. As shown in FIGS. 1 and 2, this electric wire connecting portion 30 includes an electric wire placement plate portion 31 and a pair of crimping pieces 32 which are provided at both side edges of the electric wire placement plate portion 31 so as to extend therefrom.

The electric wire placement plate portion 31 extends from a proximal end of the basic terminal holding plate 21 so that the electric wire 50 can be placed thereon.

The pair of crimping pieces 32 are crimped on to a conductor of the electric wire 50 which is placed on the electric wire placement plate portion 31, whereby the conductor of the electric wire 50 is crimped and connected to the electric wire placement plate portion 31.

Thus, in the female terminal fitting 10 of the embodiment that has been described heretofore, by changing the inserting direction of the mating terminal fitting 40 which is inserted into the terminal holding groove 25, the extending directions of the electric wires which are connected to the terminal fittings can be changed as shown in FIGS. 8A and 8B.

In the case of FIG. 8A, the inserting direction of the mating terminal fitting 40 follows a direction denoted by an arrow X1 which follows an axis of the female terminal fitting 10, in which case the electric wires 50 which are connected to the terminal fittings extend coaxially. In contrast, in the case of FIG. 8B, the inserting direction of the mating terminal fitting 40 follows a direction denoted by an arrow X2 which is at right angles to the axis of the female terminal fitting 10, in which case the electric wires 50 which are connected to the terminal fittings extend in directions orthogonal to each other.

In the female terminal fitting 10 of the embodiment that has been described heretofore, the plurality of terminal holding plates 21, 22, 23, 24 which configure the terminal connecting portion 20 are provided as the single metallic plate which is continuous overall via the bending margins M1, M2, M3, as shown also in FIG. 6.

Then, the auxiliary terminal holding plates 22, 23, 24 which continue to the basic terminal holding plate 21 via the bending margins M1, M2, M3, respectively, are folded at the portions where the bending margins M1, M2, M3 are provided so as to be stacked on to the basic terminal holding plate, whereby the auxiliary terminal holding plates 22, 23, 24 are stacked up on the basic terminal holding plate 21.

When the auxiliary terminal holding plate 24 which is to be stacked at the uppermost level is folded to be stacked so completely, the fixing piece 27 which is provided on the terminal holding plate 24 which is stacked at the uppermost level is brought into engagement with the locking hole 21*b* in the terminal holding plate 21 at a lowermost level, whereby the terminal holding plate 24 stacked at the uppermost level as an uppermost layer is fixed to the terminal holding plate 21 at the lowermost level. In this fixed state, the two intermediate terminal holding plates 22, 23 which are positioned at an intermediate between the uppermost level and the lowermost level are sandwiched by the uppermost terminal holding plate 24 and the lowermost terminal holding plate 21, whereby the stacked state is fixed.

Namely, in the female terminal fitting 10 of the embodiment, the terminal connecting portion 20 which is configured of the plurality of terminal holding plates 21, 22, 23, 24 which are stacked up can be fabricated only through pressing. Thus, the fabrication process can be simplified, which can realize a reduction in fabrication costs.

In addition, in the female terminal fitting 10 of the embodiment, the uppermost terminal holding plate 24 is fixed to the lowermost terminal fitting plate 21 by the bending margin M3 which is positioned at one end side and the fixing piece 27 which is positioned at the other end side thereof. Namely, the uppermost terminal holding plate 24 and the lowermost terminal holding plate 21 hold firmly the plurality of intermediate terminal holding plates 22, 23 in such a state that the uppermost and lowermost terminal holding plates 24, 21 are fastened at both the end portions thereof. Consequently, there is no such situation that the stacked terminal holding plates 21, 22, 23, 24 separate from one another due to warping. Therefore, there is no such situation that the holding force with which the mating terminal fitting 40 is held is reduced in any way due to the separation of the stacked terminal holding plates 21, 22, 23, 24 from one another, whereby the plate-shaped mating terminal fitting 40 can be held firmly, thereby making it possible to maintain the stable connecting performance.

Additionally, in the female terminal fitting 10 of the embodiment, as also shown in FIG. 3, the multiplicity of contact portions 220 which are disposed on the terminal holding groove 25 in the terminal connecting portion 20 are disposed so as to be separated at the two locations which are offset in the inserting direction of the mating terminal fitting 40 into the terminal holding groove 25, whereby the multiple contact point connection can be realized in which the terminal connecting portion 20 is connected to the mating terminal fitting 40 over a wide range of the mating terminal fitting 40, thereby making it possible to improve the contact reliability with the connecting terminal fitting 40. Additionally, since the contact points 220 are disposed so as to be separated at the two locations, an insertion force with which the mating terminal fitting 40 is inserted is reduced.

In the female terminal fitting 10 of this embodiment, since the electric wire connecting portion 30 is also made of the metallic plate, the whole of the female terminal fitting 10 including the terminal connecting portion 20 can be fabricated only through pressing, whereby a further reduction in fabrication costs can be realized by simplifying the fabrication process.

In the female terminal fitting 10 of the embodiment, the electric wire connecting portion 30 is made of the metallic plate and includes no electric wire connecting male screw member, and therefore, there is no such situation that the electric resistance of the female terminal fitting 10 is increased.

The invention is not limited to the embodiment that has been described heretofore and hence can be modified or improved as required. In addition, the materials, shapes, dimensions, numbers and locations of the constituent parts in the embodiment described above are not limited to those described in the embodiment and hence can be determined arbitrarily as long as the invention can be achieved.

For example, the number of terminal holding plates which are stacked at the terminal connecting portion can be set to any number which is two or greater. In the event that the number of terminal holding plates which are stacked at the terminal connecting portion is five or greater, terminal holding plates may also be provided on the auxiliary terminal holding plates shown in FIG. 6 so as to continue thereto via bending margins.

In the event that the plurality of contact portions which are disposed on the terminal holding groove are set at a plurality locations which are offset in the inserting direction of the mating terminal fitting, locations where to dispose the contact portions may be set at three or more locations which are offset in the inserting direction of the mating terminal fitting.

The specific structure of the locking portion which is provided at the proximal end side of the basic terminal holding plate so as to lock the fixing piece which is formed at the one end of the auxiliary terminal fitting plate which is stacked to be positioned at the uppermost level is not limited to the locking hole 21*b* shown in the embodiment. For example, a configuration may be adopted in which a locking projection is formed on an elastic piece which is cut to rise in the basic terminal holding plate at the proximal end side thereof as the locking portion provided at the proximal end of the basic terminal holding portion, and an engaging hole into which the engaging projection is fitted engagingly is provided in the fixing piece which is formed at the one end of the auxiliary terminal holding plate.

Here, the characteristics of the female terminal fitting according to the embodiments will be itemized under [1] to [3] in a summarized fashion as herebelow.

[1] The female terminal fitting (10) including: the terminal connecting portion (20) which is formed by stacking the plurality of metallic terminal holding plates (21, 22, 23, 24) on one another; and which enables the plate-shaped mating terminal fitting (40) to be inserted into the terminal holding grooves (21*a*, 22*a*, 23*a*, 24*a*) which are respectively formed in the terminal holding plates (21, 22, 23, 24) so as to communicate with one another and the electric wire connecting portion (30) which is provided so as to continue to the terminal connecting portion (20) and to which the electric wire (50) is connected, wherein the plurality of terminal holding plates (21, 22, 23, 24) are configured of the basic terminal holding plate (21) which is formed integrally with the one end of the electric wire connecting portion (30), and the plurality of auxiliary terminal holding plates (22, 23, 24) which are formed integral with the corresponding edges of the basic terminal holding plate (21) via the corresponding bending margins (M1, M2, M3) and which are folded up and then down on to the basic terminal holding plate (21) at the portions where the bending margins (M1, M2, M3) are provided so that the auxiliary terminal holding plates (22, 23, 24) are in a stacked state on the basic terminal holding plate (21), and on the auxiliary terminal holding plate (24) in the plurality of auxiliary terminal holding plates (22, 23, 24) which is stacked to be at the uppermost level, the fixing piece (27) is formed integrally with the edge portion (24*b*) at the side which lies opposite to the side where the bending margin (M3) is provided, the fixing portion (27) being configured so as to be brought into engagement with the locking portion (the locking hole 21*b*) which is formed on the basic terminal holding plate (21) in such a state that the auxiliary terminal holding plate (24) which is to be stacked at the uppermost level is so stacked as the uppermost layer to fix the plurality of auxiliary terminal holding plates (22, 23, 24) which are stacked on one another.

[2] In the female terminal fitting (10) according to [1] above, the terminal holding grooves (21*a*, 22*a*, 23*a*, 24*a*) include the terminal insertion grooves (210) into which the mating terminal fitting (40) can be inserted and contact portions (220) which are provided on the facing inner side surfaces (211, 212) of the terminal insertion grooves (210) so as to project therefrom for press contact with surfaces of the mating terminal fitting (40) which is inserted into the terminal insertion grooves (210), and in the stacked state of the plurality of terminal holding plates (21, 22, 23, 24), the plurality of contact portions (220) are formed in positions which are offset from each other in an inserting direction of the mating terminal fitting (40).

[3] In the female terminal fitting (10) according to [1] or [2], the electric wire connecting portion (30) includes the electric wire placement plate portion (31) which is made of the metallic plate and which extends from the proximal end of the basic terminal holding plate (21) to place the electric wire (50) thereon and the crimping pieces (32) which are provided on both side edges of the electric wire placement plate portion (31) so as to extend therefrom to be crimped to the electric wire (50) which is placed on the electric wire placement plate portion (31).

While the invention has been described in detail and by reference to the specific embodiment, it is obvious to those skilled in the art to which the invention pertains that various alterations or modification can be made thereto without departing from the spirit and scope of the invention.

According to the embodiments, there are provided advantageous effects that a reduction in fabrication costs can be realized by simplifying the fabrication process and that there is no such situation that the stacked terminal holding plates are separated due to warping, whereby the plate-shaped mating terminal fitting can be held firmly, thereby making it possible to maintain the stable connecting performance. The embodiments which provide these advantageous effects are effectively applied to the female terminal fitting which has the terminal connecting portion which is formed by stacking up the plurality of terminal holding plates.

What is claimed is:

1. A female terminal fitting comprising:

a terminal connecting portion which is formed by stacking a plurality of metallic terminal holding plates on one another and which enables a plate-shaped mating terminal fitting to be inserted into terminal holding grooves which are respectively formed in the terminal holding plates so as to communicate with one another; and an electric wire connecting portion which is provided so as to continue to the terminal connecting portion and to which an electric wire is connected, wherein the plurality of terminal holding plates are configured of a basic terminal holding plate which is formed integrally with one end of the electric wire connecting portion, and a plurality of auxiliary terminal holding plates which are formed integrally with corresponding edges of the basic terminal holding plate via corresponding bending margins and which are folded up and then down on to the basic terminal holding plate at portions where the bending margins are provided so that the auxiliary terminal holding plates are in a stacked state on the basic terminal holding plate, and on an auxiliary terminal holding plate in the plurality of auxiliary terminal holding plates which is stacked to be at an uppermost level, a fixing piece is formed integrally with an edge portion at a side which lies opposite to a side where the bending margin is provided, the fixing portion being configured so as to be brought into engagement with a locking portion which is formed on the basic terminal holding plate in such a state that the auxiliary terminal holding plate which is to be stacked at the uppermost level is so stacked as an uppermost layer to fix the plurality of auxiliary terminal holding plates which are stacked on one another.

2. The female terminal fitting according to claim 1, wherein the terminal holding grooves include terminal insertion grooves into which the mating terminal fitting can be inserted and contact portions which are provided on facing inner side surfaces of the terminal insertion grooves so as to project therefrom for press contact with surfaces of the mating terminal fitting which is inserted into the terminal insertion grooves, and in the stacked state of the plurality of terminal holding plates, the plurality of contact portions are formed in positions which are offset from each other in an inserting direction of the mating terminal fitting.

3. The female terminal fitting according to claim 1, wherein the electric wire connecting portion comprises an electric wire placement plate portion which is made of a metallic plate and which extends from a proximal end of the basic terminal holding plate to place the electric wire thereon and crimping pieces which are provided on both side edges of the electric wire placement plate portion so as to extend therefrom to be crimped to the electric wire which is placed on the electric wire placement plate portion.

* * * * *